US011197800B2

(12) United States Patent
Kiernan

(10) Patent No.: US 11,197,800 B2
(45) Date of Patent: Dec. 14, 2021

(54) ATTACHABLE EXERCISE DEVICE FOR TREATING AND STRETCHING MUSCLES, FASCIA AND JOINTS

(71) Applicant: UfxtheTwist LLC, Rockaway Park, NY (US)

(72) Inventor: James E. Kiernan, Rockaway Park, NY (US)

(73) Assignee: UfxtheTwist LLC, Rockaway Park, NY (US)

( * ) Notice: Subject to any disclaimer, the term of this patent is extended or adjusted under 35 U.S.C. 154(b) by 395 days.

(21) Appl. No.: 16/363,076

(22) Filed: Mar. 25, 2019

(65) Prior Publication Data

US 2019/0307639 A1 Oct. 10, 2019

Related U.S. Application Data

(60) Provisional application No. 62/757,524, filed on Nov. 8, 2018, provisional application No. 62/652,340, filed on Apr. 4, 2018.

(51) Int. Cl.
*A61H 39/04* (2006.01)
*A61H 7/00* (2006.01)

(52) U.S. Cl.
CPC ..... *A61H 39/04* (2013.01); *A61H 7/002* (2013.01); *A61H 2201/0119* (2013.01); *A61H 2201/0157* (2013.01)

(58) Field of Classification Search
CPC ..... A61H 7/00; A61H 7/002; A61H 7/003; A61H 39/04; A61H 2015/0042; A61H 1/008; A61H 2201/0107; A61H 2201/1685
See application file for complete search history.

(56) References Cited

U.S. PATENT DOCUMENTS

| | | | | |
|---|---|---|---|---|
| 7,087,004 | B1 * | 8/2006 | Berke | A61H 7/002 482/132 |
| 2010/0222809 | A1 * | 9/2010 | Grabill | A61H 39/04 606/204 |
| 2011/0166481 | A1 * | 7/2011 | Rhoad | A61H 7/002 601/1 |
| 2013/0066245 | A1 * | 3/2013 | Dagan | A61H 15/0092 601/118 |

(Continued)

FOREIGN PATENT DOCUMENTS

CA 3010189 A1 1/2019

OTHER PUBLICATIONS

Vertiball precision massager; https://www.vertiball.com/.
Mobility Ball; https://www.acumobility.com/products/mobility-ball-level-1/.

*Primary Examiner* — Samchuan C Yao
*Assistant Examiner* — Cana A Gallegos
(74) *Attorney, Agent, or Firm* — Alix, Yale & Ristas, LLP

(57) ABSTRACT

An exercise device for stretching muscles, fascia and joints includes a rear base that transitions to a front nipple made from a solid and firm material. The device is attachable rigidly to a stationary structure such as a door jam in numerous different positions for use in a variety of exercises. The device may be attachable via a clamp unit that can be tightened laterally or other attachment means to attach to the door jam. The exercise device may be modular in form made from a plurality of pieces that are attachable to one another to form the device in a solid unitary structure.

19 Claims, 22 Drawing Sheets

(56) References Cited

U.S. PATENT DOCUMENTS

| | | | | |
|---|---|---|---|---|
| 2016/0095781 | A1* | 4/2016 | Hudson | A61H 7/001 601/136 |
| 2016/0317387 | A1* | 11/2016 | Cox | A61H 39/04 |
| 2016/0324717 | A1* | 11/2016 | Burton | A61H 7/001 |
| 2018/0104144 | A1 | 4/2018 | Faussett | |
| 2018/0110673 | A1* | 4/2018 | Davis | A61H 39/04 |
| 2018/0142832 | A1* | 5/2018 | Inouye | A61H 15/00 |
| 2018/0280228 | A1 | 10/2018 | Bouch et al. | |
| 2018/0296430 | A1 | 10/2018 | Bouch et al. | |

* cited by examiner

ATTACHABLE EXERCISE DEVICE FOR TREATING AND STRETCHING MUSCLES, FASCIA AND JOINTS

CROSS-REFERENCE TO RELATED APPLICATION

This application claims priority to 62/652,340, filed Apr. 4, 2018, and 62/757,524, filed Nov. 8, 2018, the entire content of which is incorporated herein by reference.

BACKGROUND

The disclosed embodiments relate to exercise devices, and in particular an exercise device that rigidly attaches to a stationary structure that allows a user to exercise and/or stretch all three structures of muscles, fascia and joints.

Typically individuals can perform stretches referred to as "long lever" stretching exercises, such as touching ones toes and other stretches. Some related stretch techniques exist (yoga, for example). However, such known long lever techniques do not allow access to all muscles, fascia and joints without assistance of a medical professional to manipulate the bodily areas of interest.

Additionally, non-stationary exercise or treatment products and devices exist that focus on massaging muscles, including for example, massage balls, therapy canes, massage bars, electric massagers and foam rollers. These products are deficient in that they do not permit exercising of all three of muscles, fascia and joints. Additional drawbacks exist in that many of them require a user to hold it, are cumbersome and do not allow deep penetration.

At least one product for use in massage treatment exists that is mountable on a wall via suction and provides a rolling ball at a distal front end for users to massage via rolling contact. Products like this carry a significant drawback in that many advantageous exercises, including those that require deeper penetration, cannot be performed with the rolling ball. For example, any exercise that involves twisting of the individual's body relative to the distal surface is impossible given the rotating ball. An additional drawback to such a device is that when mounted to a wall, there is no clearance rear of the device. Maintaining clearance rear of the device would be extremely helpful and provide for ability to perform significantly more exercises by allowing the user's limbs to be positioned rear of the devices. Allowing such clearance for a user's limbs not only allows for different types of exercises, but allows the user to perform any exercises with increased force and power, which may be necessary to exercise certain muscles.

None of these prior art devices or methods allows an individual to stretch and exercise all three of muscles, fascia and joints, and perform both short and long lever exercises without the assistance of a healthcare professional or another individual, or perform exercises that involve twisting the body relative to the contact portion of the device or with clearance rear of the device. It would be useful to provide a device that remedies these drawbacks in the prior art.

SUMMARY

In a preferred embodiment, an exercise device includes a base member, transition portion and a distal nipple. The base member has a rear portion configured for rigid engagement with a stationary object. The transition portion extends from the base member away from the rear portion of the base. The nipple has a rounded contour and is formed as the distal end of the transition portion. The nipple is rigidly fixed relative to the base member and rigidly fixed relative to the stationary object when the rear portion of the base member is engaged with the stationary object.

In another embodiment, an exercise system includes a stationary object with a first width and an exercise device. The exercise device comprises a rear base portion that transitions to a front rigid nipple. The base portion has a second width. The exercise device is rigidly attached to the stationary object at the rear base portion, thereby rigidly fixing the nipple relative to the stationary object.

The inventive embodiments allow at least two significant actions unavailable within comparable prior art devices. The first is a turning motion, which requires a user to locate a tight muscle, fascia or joint. The inventive device allows one to hold a fixed point on the body (i.e., muscle, fascia or joint), and turn the body around the fixed point. This fixed position of the device allows the user to achieve internal glide of resistant tissues. The second action involves the device being fixed on a muscle, fascia or joint with the user moving his or her body moving up and down without turning. This exercise is useful to free local, leathery tissue. In both cases, the device is fixed in place without any moving parts. In addition, the device being fixable to a stationary building structure, such as a door jam, with clearance on both sides rear of the contact point allows a user to create depth with force against the opposite door jam. A fixed device, such as the disclosed embodiments, allows a user to control the targeted tissues with body motion, as opposed to device movement, as with many of the known prior art devices.

DETAILED DESCRIPTION

Figure 1:
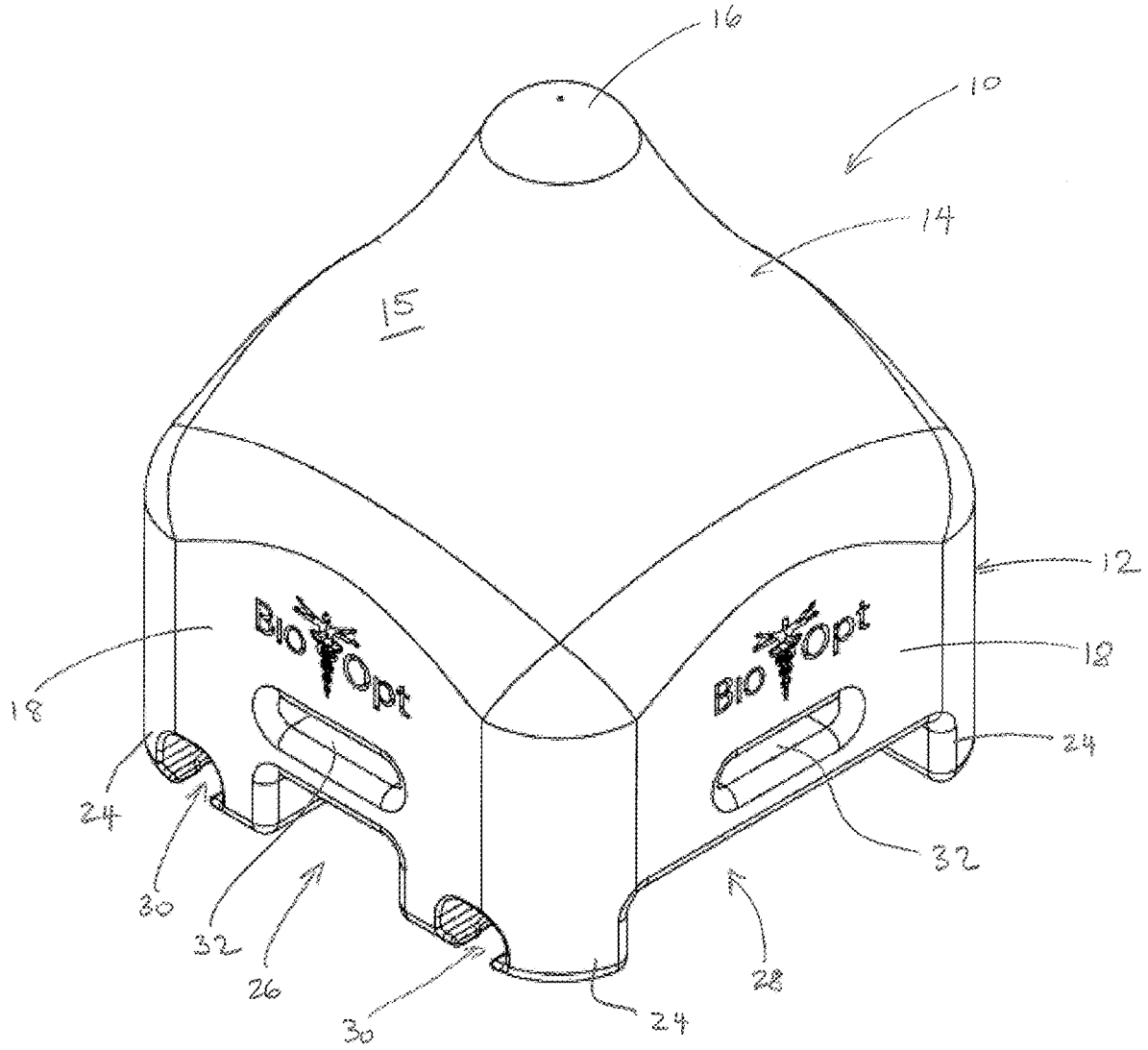
FIG. 1 is a top perspective view of a first embodiment of the disclosed device.

Among the benefits and improvements disclosed herein, other objects and advantages of the disclosed embodiments will become apparent from the following wherein like numerals represent like parts throughout the several figures. Detailed embodiments of an exercise device for stretching muscles, fascia and joints are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined. The terms "exercise" and "stretch", and all variations and tenses of these terms, are used synonymously within the description of the inventive concepts of the device and methods of using.

FIGS. 1-6 depict a preferred embodiment of the disclosed exercise device from different views. With reference to these Figures, the device 10 includes a base portion 12 and a cap portion 14 that transitions from of the base portion on a front side to a substantially rounded distal nipple 16. The base portion 12 includes four sides 18 separating a front portion 20 and a rear portion 22. A foot 24 extends from the rear portion 22 at each corner. Each foot 24 is spaced from two adjacent feet with the spacing between each foot 24 defining an open rear slot 26, 28 between each adjacent foot 24.

Figure 2:
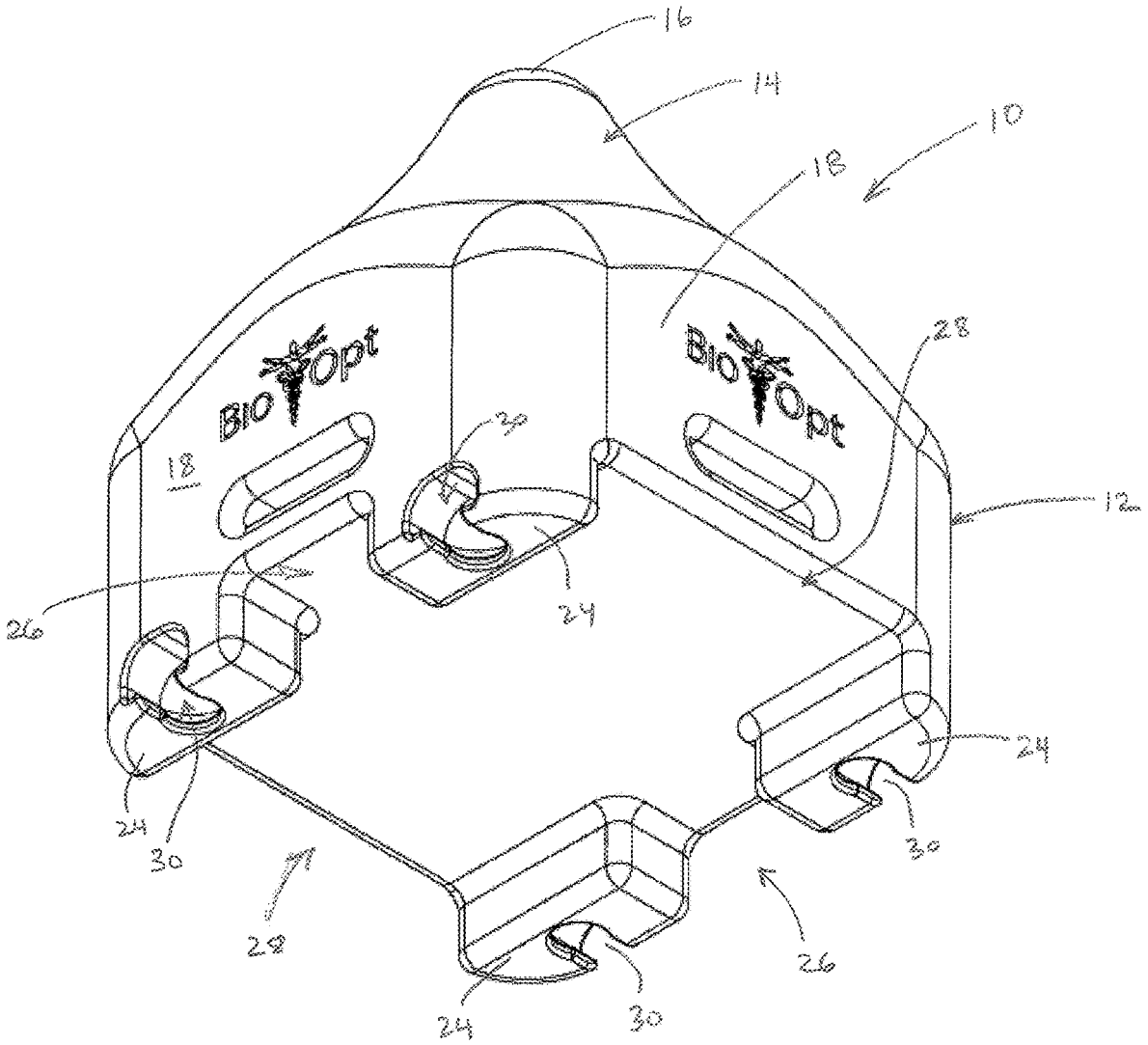
FIG. 2 is a bottom perspective view of the embodiment of the device of FIG. 1.
Figure 3:
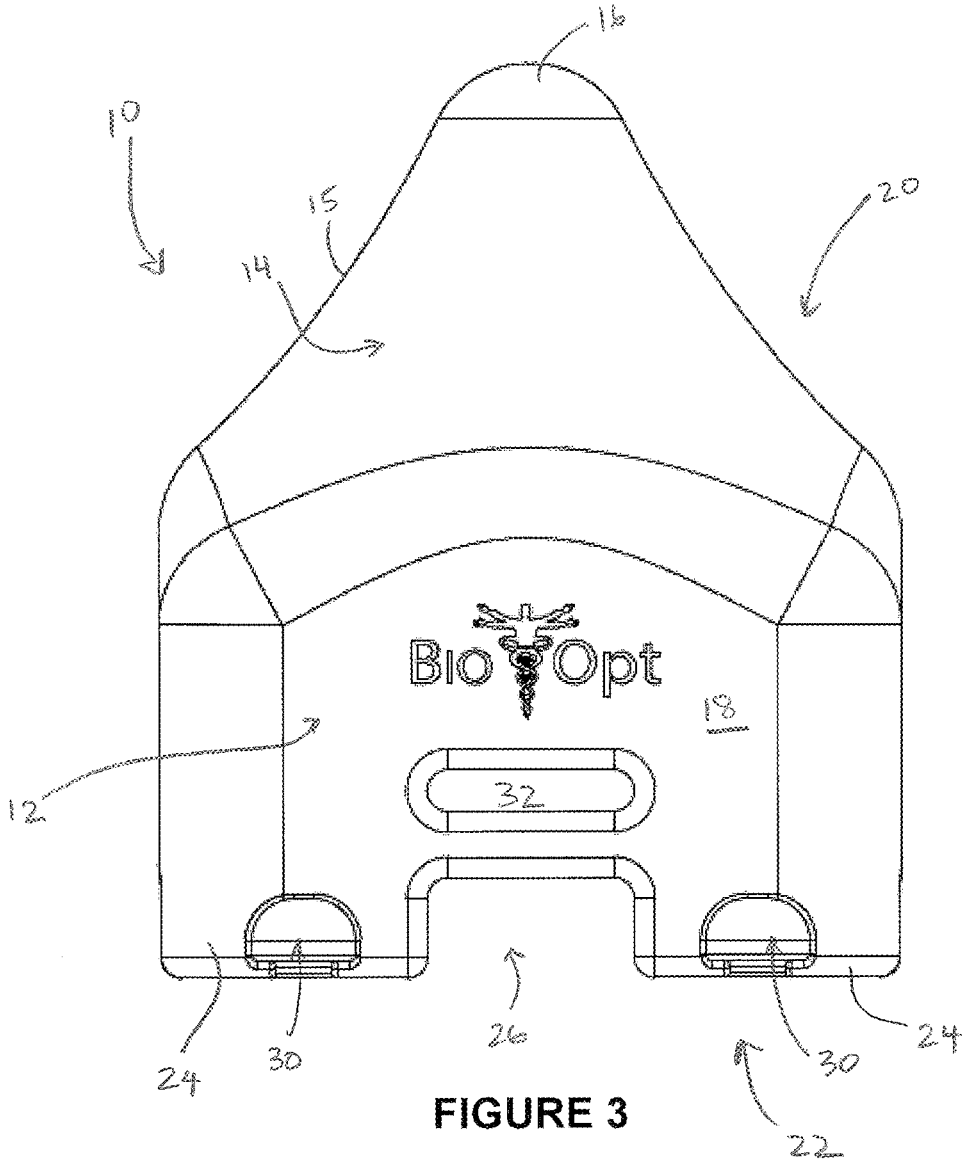
FIG. 3 is a side elevation view of the embodiment of the device of FIG. 1.
Figure 4:
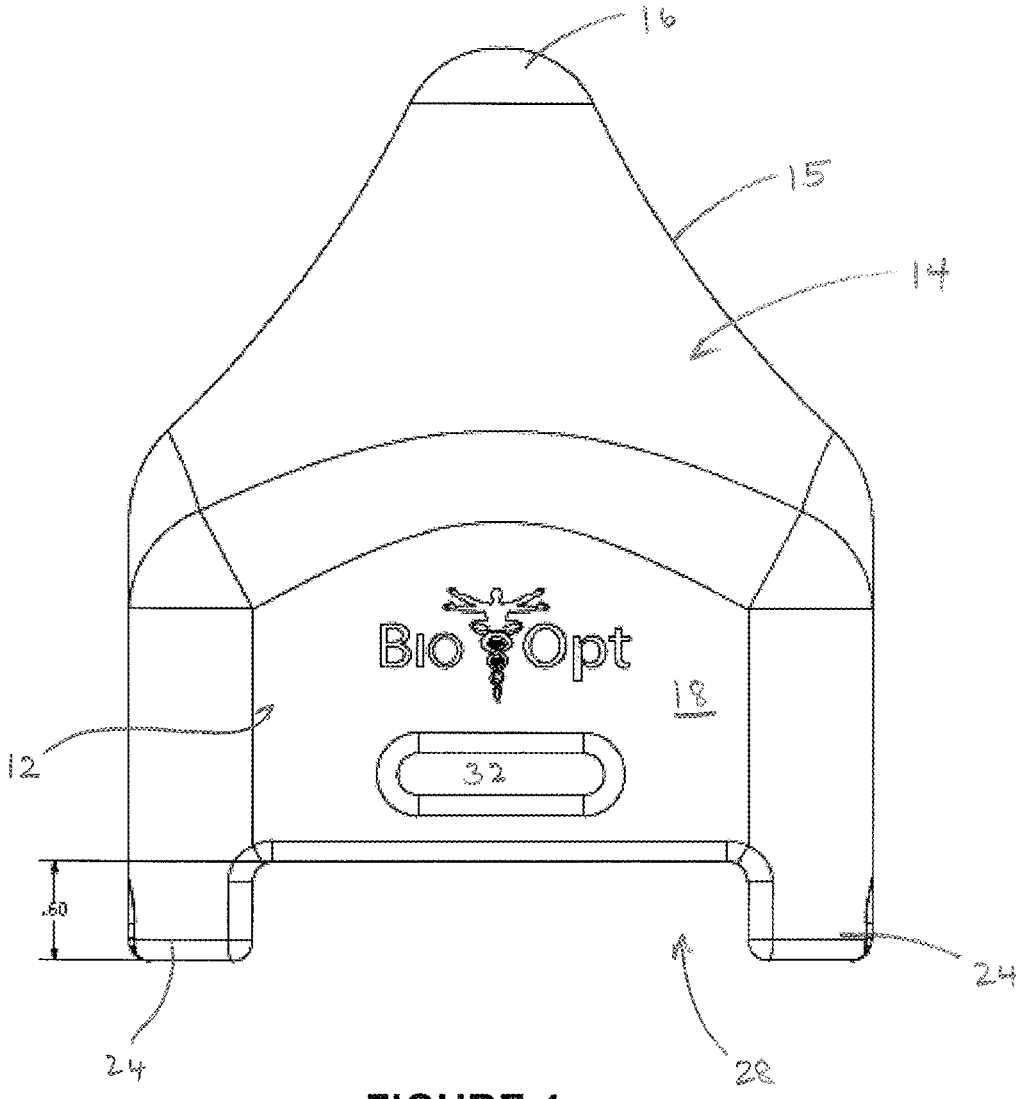
FIG. 4 is a side elevation view of the embodiment of the device of FIG. 1 taken 90° relative to the view in FIG. 3.
Figure 5:
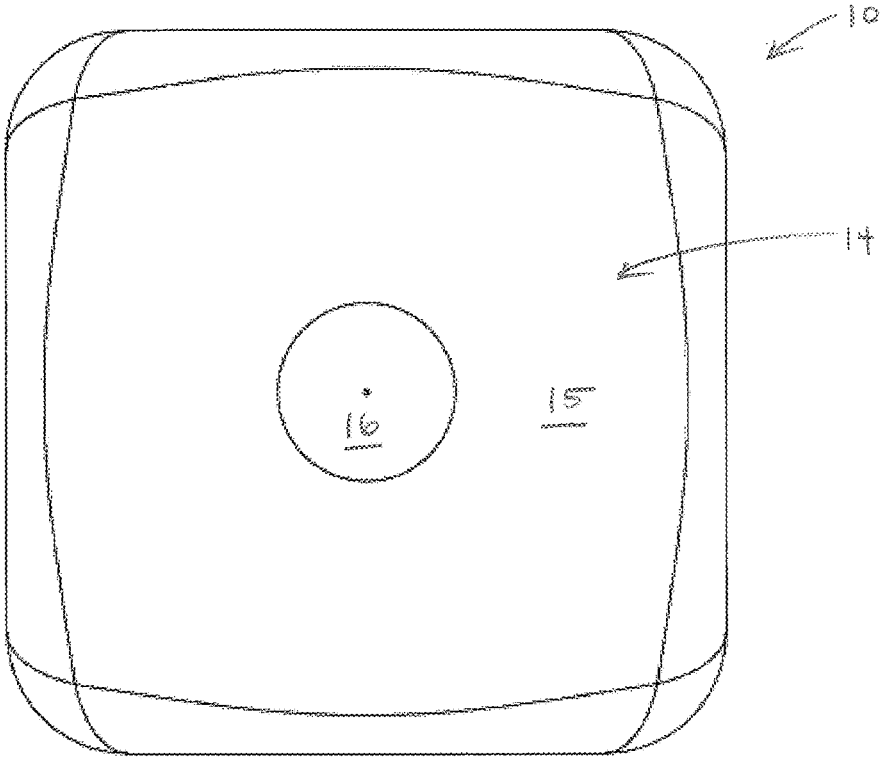
FIG. 5 is a top elevation view of the embodiment of the device of FIG. 1.
Figure 6:
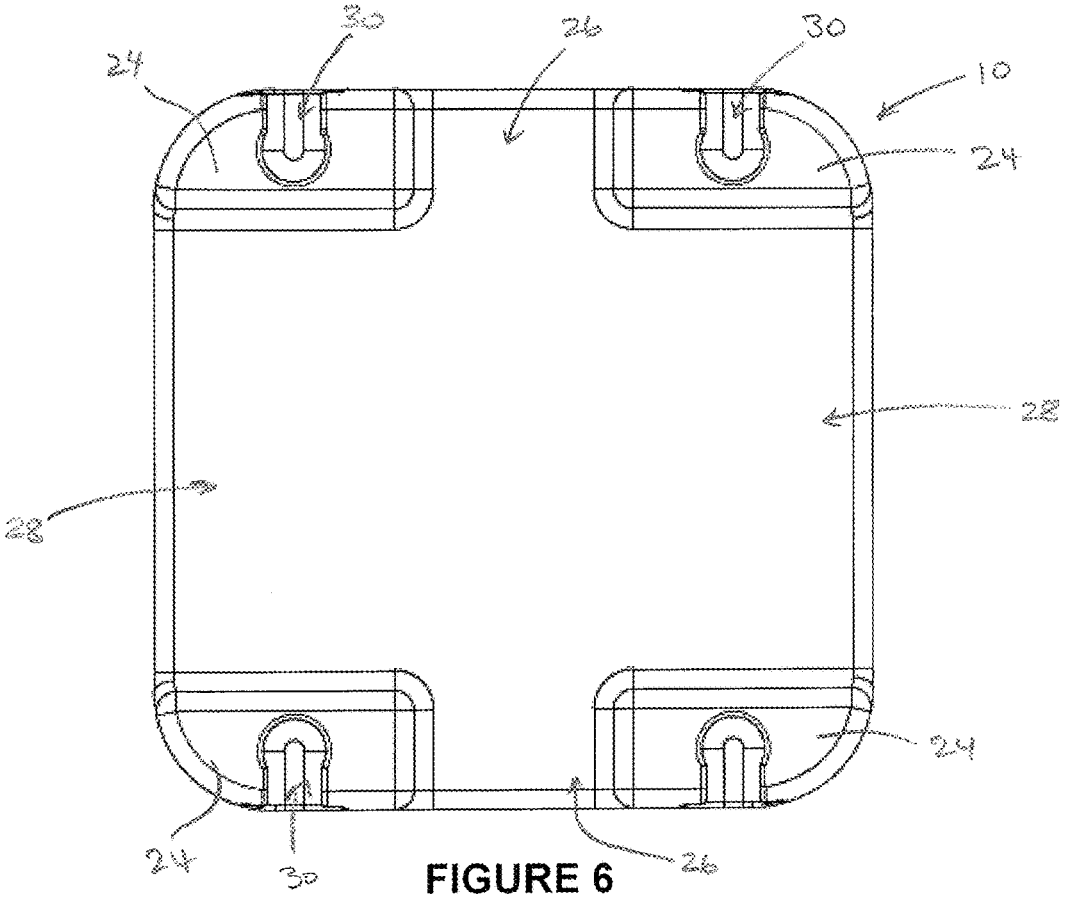
FIG. 6 is a bottom elevation view of the embodiment of the device of FIG. 1.

As can be seen most clearly in FIGS. 2 and 6, rear slots 26 (narrow) on opposing pair of sides of the base are sized differently from rear slots 28 (wide) on the other opposing pair of sizes. Rear slots 26 are aligned to provide a first channel through opposite sides of the rear portion, and rear slots 28 are aligned to provide a second channel through opposite sides of the rear portion 22. This is to accommodate stationary structures of varying sizes and configurations (such as, for example, different door jams). As can be seen, each foot 24 also includes a notch 30 and each side 18 defines a side slot 32. In typical operation of the device 10, the notches 30 in the feet 24 are configured to maintain a nub of a suction cup 34, and the side slots 32 are configured to attach to straps like those shown as reference numeral 36.

The depicted cap portion 14 includes a transition portion 15 with individual surfaces that transition substantially evenly from the front portion of each side 18 in slightly concave contour to the rounded nipple 16. Other embodiments exist wherein the surfaces of the transition portion 15 have different concavities, are substantially flat and/or are convex.

The contour of the nipple 16 is shaped to generally mimic an elbow, allowing an individual to exercise and stretch himself by pushing, pressing, rotating and/or manipulating a portion of his body against the nipple 16 to exercise and stretch tissue, muscles and joints, as will be described in detail below.

The device 10 can be secured rigidly to a stationary structure, which is typically a building member like a wall W or door jam J, or another frame unit. For example, straps can be attached via a pair of opposite side slots 32 to secure the device 10 to a door jam J with the nipple 16 projecting outward. One opposing pair of opposing rear slots 26 is sized differently from the other opposing pair of rear slots 28 such that door jams of different dimensions can be accommodated simply by rotating the device 90° about a central axis coaxial to the nipple 16. In a preferred embodiment, the rear slots 26 extend approximately 4 inches and rear slots 28 extend approximately 6 inches. The differing dimensions of the rear slots 26 and 28 allow the device 10 to be securely attached to door jams J or similar building members that have different dimensions. Straps 36 can pass through the opposing side slots 32 to secure the device 10 to the door jam J firmly within the rear slots 26. The straps 36 can terminate on each end with hooks or J-shaped brackets 38 that assist in the rigid attachment via engaging the rear end of the door jam.

In another embodiment, the device 10 can include suction cups 34 attached to each foot 24 for securing the device to a tile wall or similar stationary surface. Typically, the suction cups 34 can be fit with nubs to be detachably retained by notches 30 in the feet of the device 10 so they can be used only when desired. However, other attachment techniques can be utilized, and are preferred, as will be discussed in detail below.

Other embodiments of the device exists without feet and rear slots like those respectively depicted as reference numeral 24, 26 and 28, and instead can be secured via a flat rear portion to a stationary surface via a layer of adhesive or suction at the rear portion or a separate resilient friction pad. These attachment mechanisms are illustrative of preferred embodiments of the device 10, and other mechanisms known to those skilled in the art for rigidly attaching the rear of the device to a stationary structure are possible as well.

Figure 7:
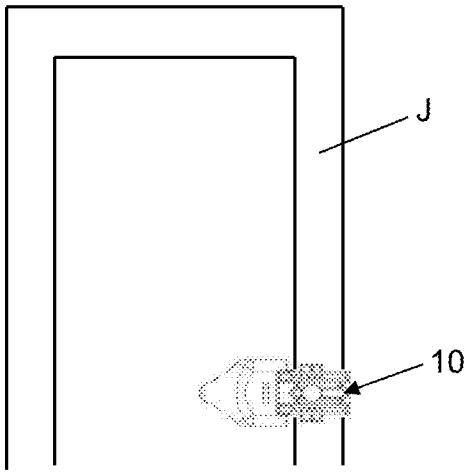
FIGS. 7-9 are generally illustrative of the adjustability of all disclosed embodiments of the device.
Figure 8:
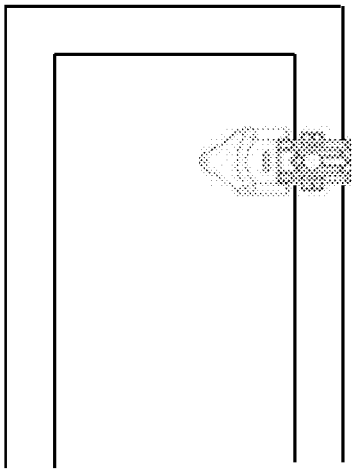
Figure 9:
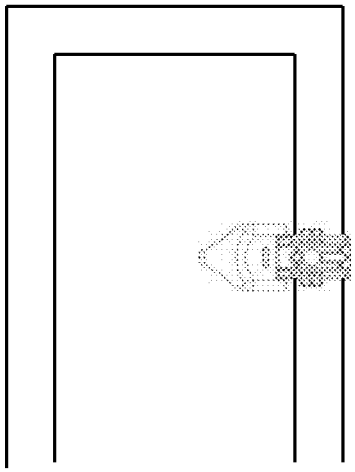
Figure 10:
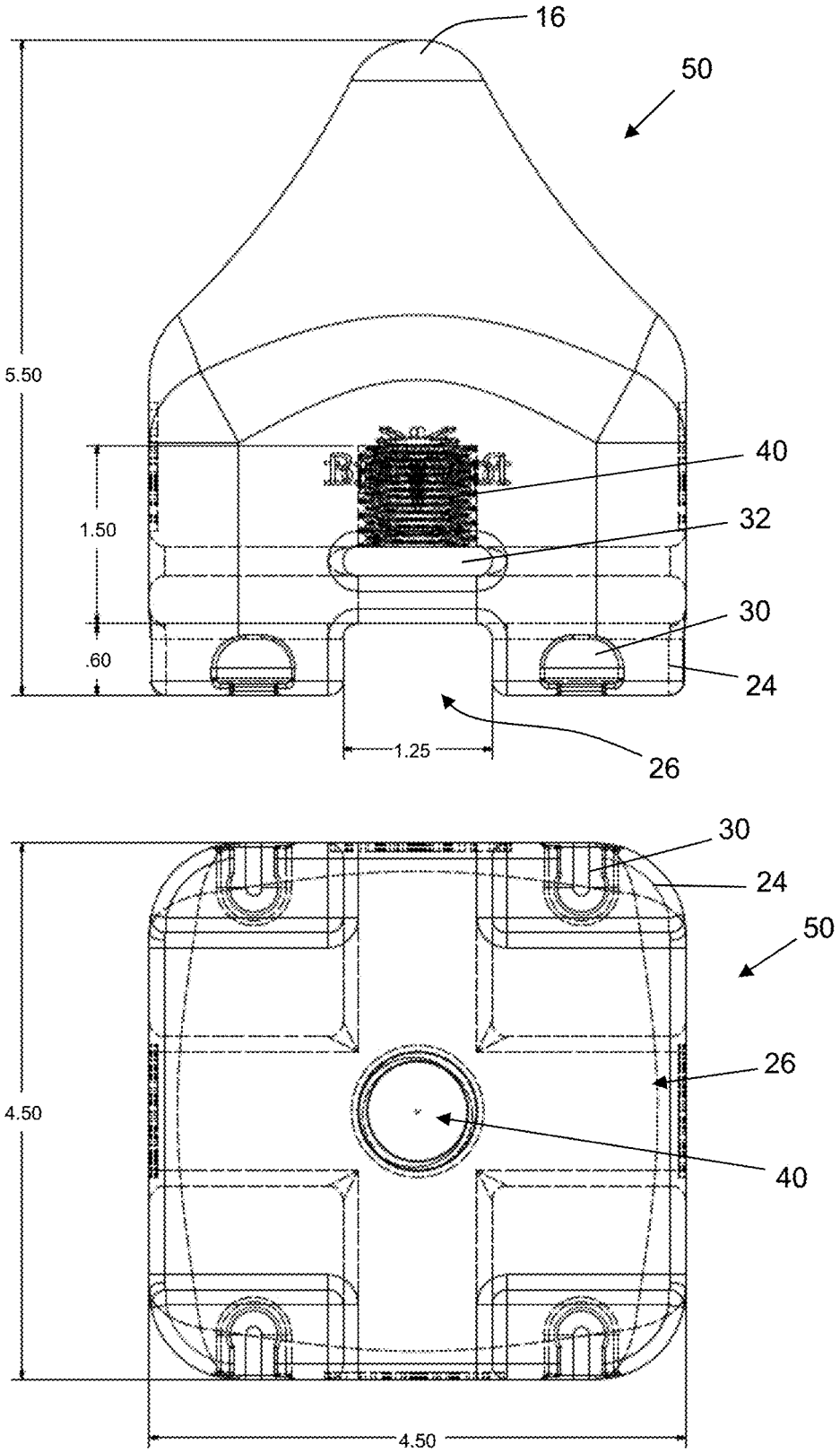
FIG. 10 shows side and bottom elevation views of another embodiment of the disclosed device, including preferred dimensions.
Figure 11:
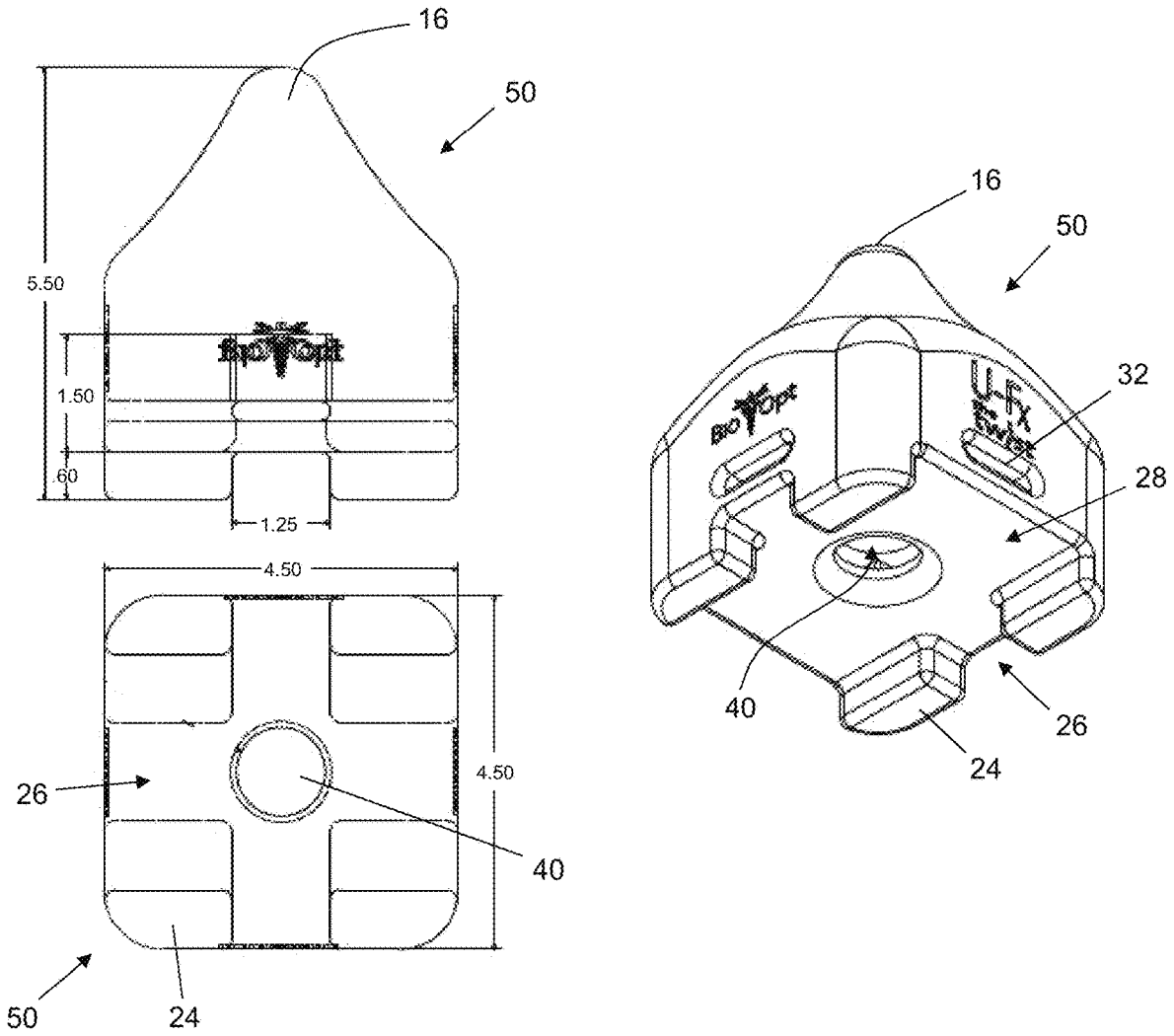
FIG. 11 shows additional views of the embodiment of FIG. 10.
Figure 12:
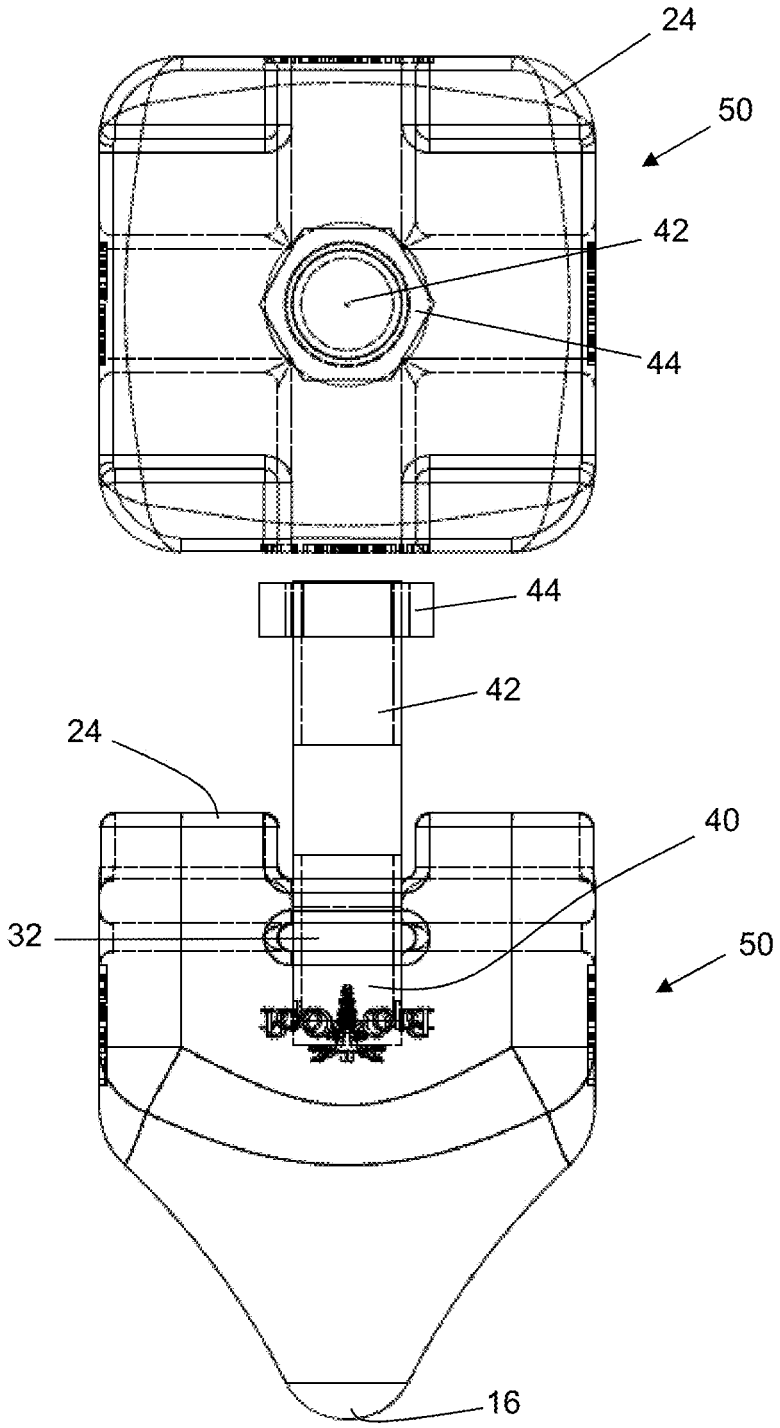
FIG. 12 depicts the embodiment of FIG. 10 with a nut and bolt attachment mechanism.
Figure 13:
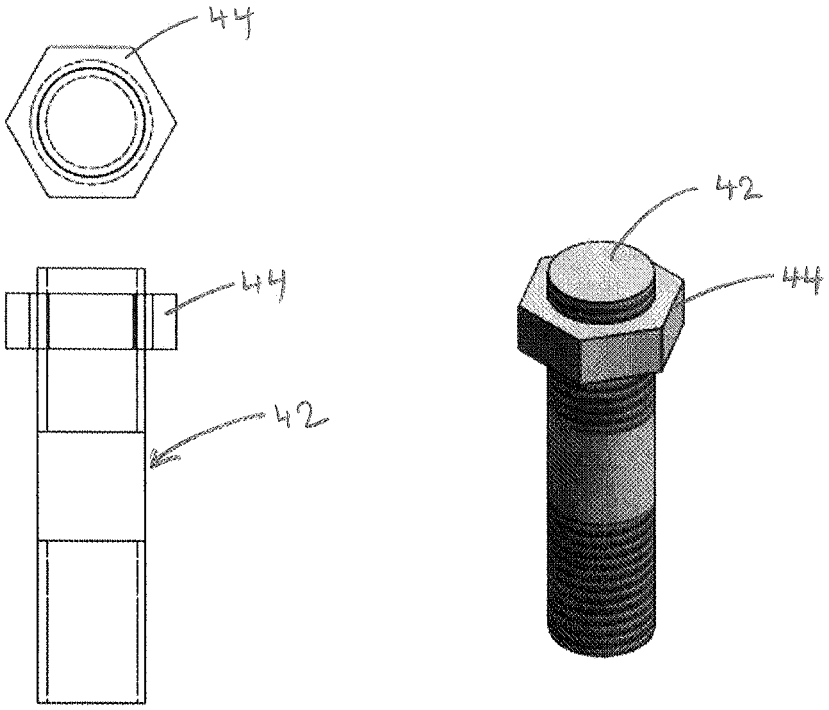
FIG. 13 shows the nut with bolt for use in attaching to the embodiment of FIG. 10.
Figure 14:
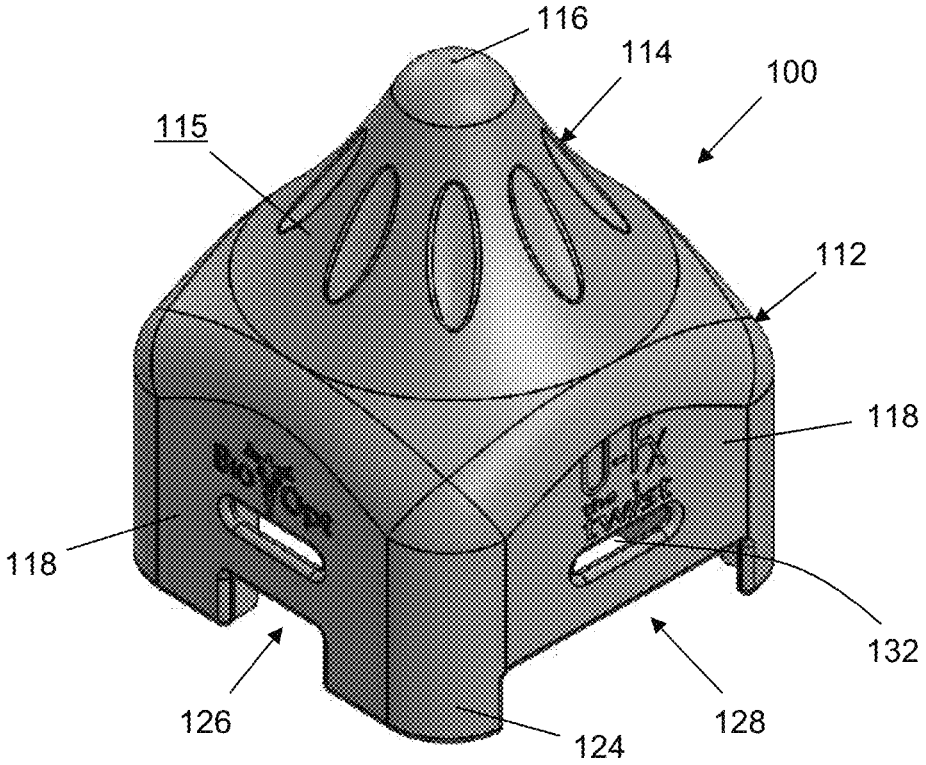
FIG. 14 is a top perspective view of a modular embodiment of the device.
Figure 15:
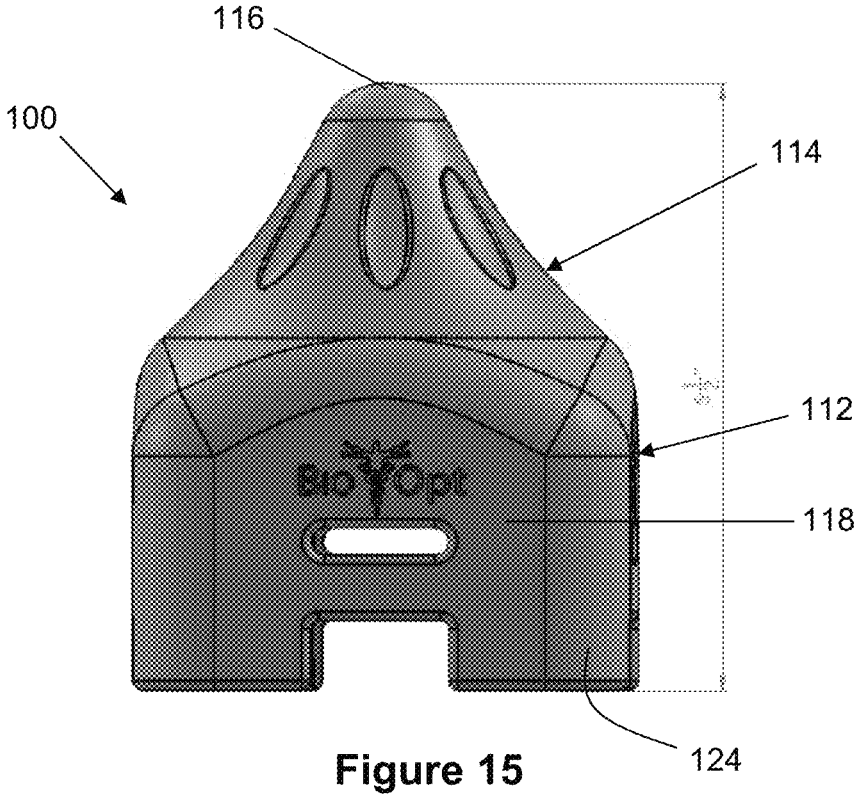
FIG. 15 is a side elevation view of the embodiment of FIG. 14.
Figure 16:
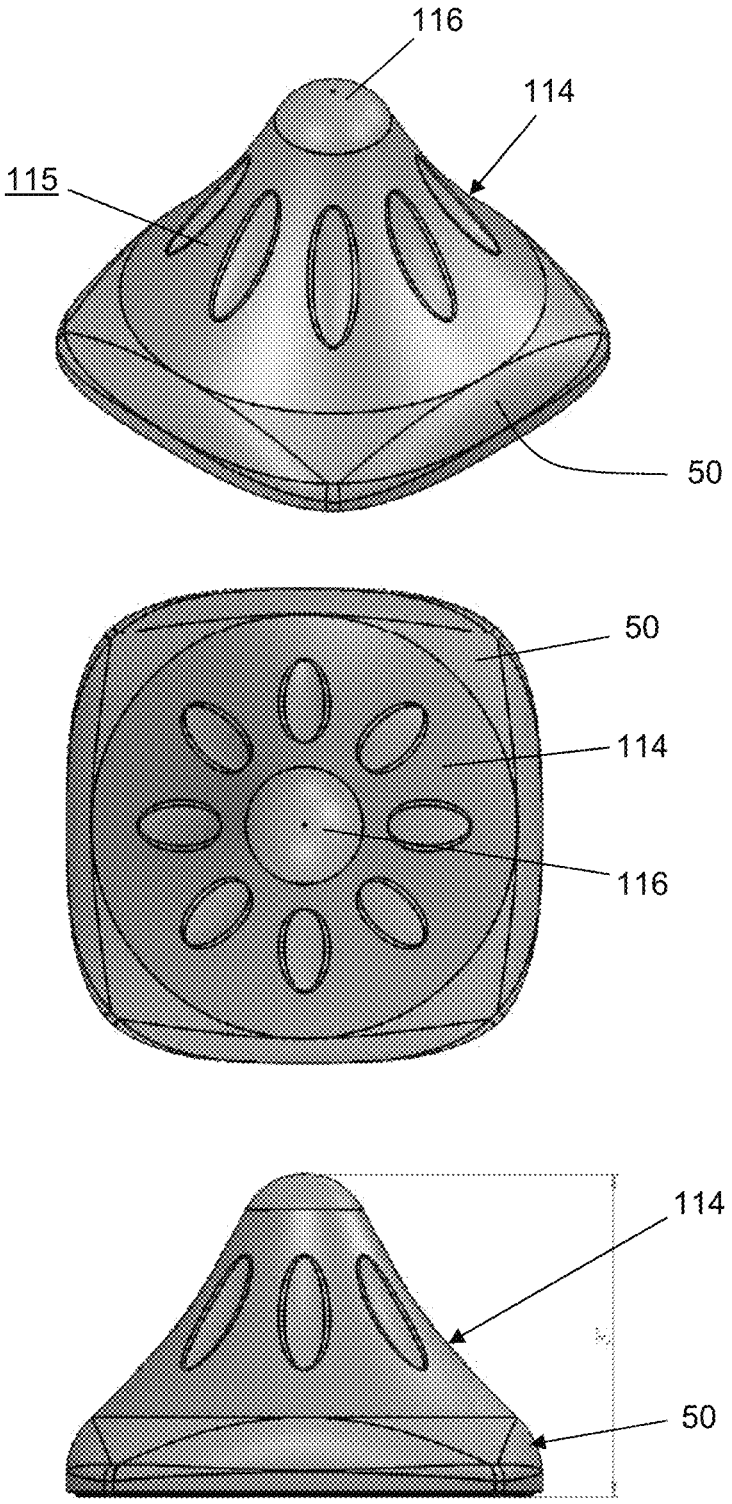
FIG. 16 shows views of the cap portion of the modular embodiment of FIG. 14 attached to a second base member.

The device 10 can be used in a large variety of stretches and exercises to stretch muscles, fascia and joints. More specifically, by attaching to a door jam J or similar narrow stationary element, a user can perform a seemingly infinite variety of exercises in areas on the front, sides and rear of his body. This is made possible by the clearance on the lateral sides of the door jam J rear of the attached device 10 to accommodate parts of a user's body that may naturally extend well beyond the point of treatment at the nipple 16. Other devices that fix only to a solid large surface would not be able to accommodate most exercises of the front of the body because the wall surface would be an obstacle. The device 10 can be easily reciprocated vertically by loosening the straps 36 (or clamp described below) and sliding along the door jam to different heights for exercising and stretching different areas of the individual's body. Non-limiting examples of treatment techniques include:

- Fixing the device to the door jam J at a lower height, as illustrated in FIG. 7, allows exercising and stretching portions of the individual's lower leg, for example, for deep flexors short lever device.
- Fixing the device to the door jam J at a higher height, as illustrated in FIG. 8, allows performing exercises and stretches of portions of the individual's upper body, such as exercises on TL short lever device, Thoracic, Lumbar extension, rotation, lateral flexion; directed Multifidii shortened non-contractial structures.
- At higher positions on the door jam J like that shown in FIG. 8, the individual can perform exercises on posterior shoulder short lever device; directed infraspinatus, teres major, teres minor, latissimus dorsi.
- At an intermediate position on the door jam J, as illustrated in FIG. 9, the individual can perform exercises on a higher position of his leg, for example quadriceps muscle, vmo, rectus, vastus Ilateralis, intermedius, short lever.

FIGS. 7-9 and the above noted exercises are merely illustrative of the adjustability of the embodiment of the exercise device 10 and the embodiments 50 and 100 discussed below, and thus the variety of techniques available; they are not limiting in terms of the exercises, stretches or positions that are possible with use of the devices 10, 50 and 100. Given the adjustability, there is a virtually endless range of muscles, fascia and joints in the body that are suitable for exercising and stretching with the device. As discussed above, the device being fixable on a stationary structure without moving parts provides significant advantages over known devices in that it allows users to perform exercises with turning body movement and by reciprocating the body vertically against a stationary point. These types of movements and exercises are effective at stretching virtually all muscles, fascia and joints, including those in deep or otherwise hard-to-reach regions, while allowing the user to control the exercises with his or her body movement.

The device 10 has been shown to be effective at stimulating mechano-receptors in joints in addition to more standard muscle and tissue stretches via movement exercises, like those illustrated herein. These types of exercises, known as "short lever" movement exercises with the disclosed exercise device 10, are extremely effective at rejuvenating muscles, fascia and joints that typically require a plethora of short lever and long lever exercises. Additionally, given that the device 10 is fixed to a stationary structure with clearance on both sides rear of the device (as opposed to being handheld or fixed to a wall), individuals can exercise and stretch a virtually limitless variety of body parts on their own without a skilled professional.

The preferred embodiments of the exercise device 10, 50 and 100 are formed of a strong polymer, such as a singular molded hard plastic. As will be discussed in detail below, with reference to FIGS. 14-20, embodiments exist that are formed of multiple pieces (i.e., modular), such as a removable base 112 attached to a transition element 114 with distal nipple 116. In the latter embodiment, a variety of sizes and configurations of each element is possible, such as a wider or more acute nipple 16. Moreover, especially in the modular version of the device 100, a variety of distal contact members can be utilized (i.e., shapes other than a round nipple).

FIGS. 10-13 depict additional embodiments of the disclosed device 50. As shown, the device 50 includes a threaded bore 40 at the rear portion 22 which is threadedly mateable with a bolt 42 that carries a nut 44. This embodiment provides for attachment to additional stationary building members that may include a hole through which the bolt passes. More specifically, this embodiment is configured to attach to gym equipment, such as for example, a squat cage. As can also be seen most clearly with reference to FIGS. 10 and 11, the individual attachment mechanisms discussed throughout this specification are not mutually exclusive to one another. The embodiment of the device 50 includes all of the rear slots (26, 28), notches 30 in feet, as well as the threaded bore 40 for engagement with nut 44. Thus, the device allows options to attach by any of the mechanisms discussed herein, including suction cups, straps, nut/bolt, or clamp.

As will be discussed in detail below, additional embodiments exist that utilize a clamp at the rear of the device to rigidly attach to a door jam or other stationary object or building structure to maintain the device in position for use.

Figure 17:
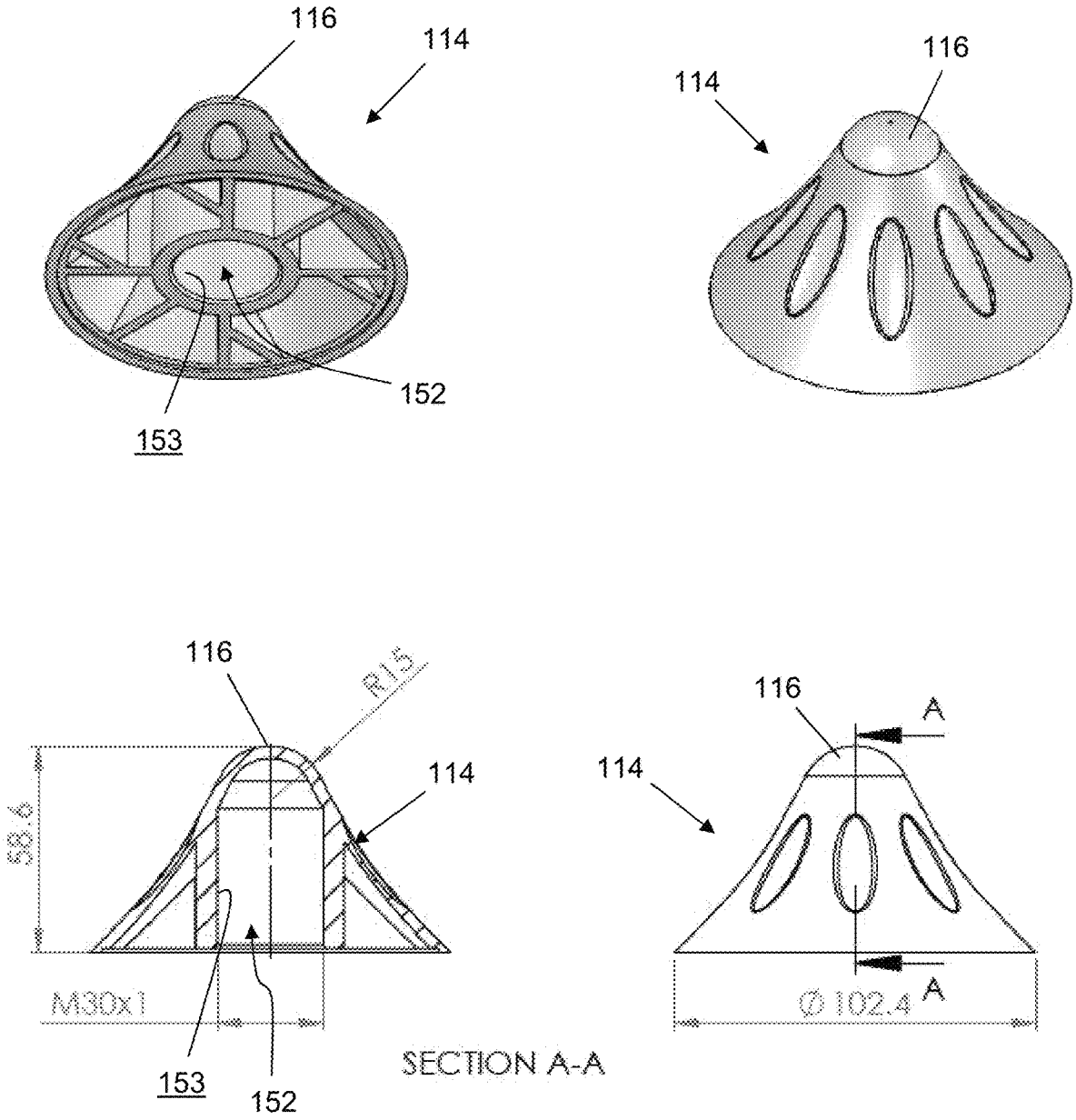
FIG. 17 shows views of the cap portion of the modular embodiment of FIG. 14.
Figure 18:
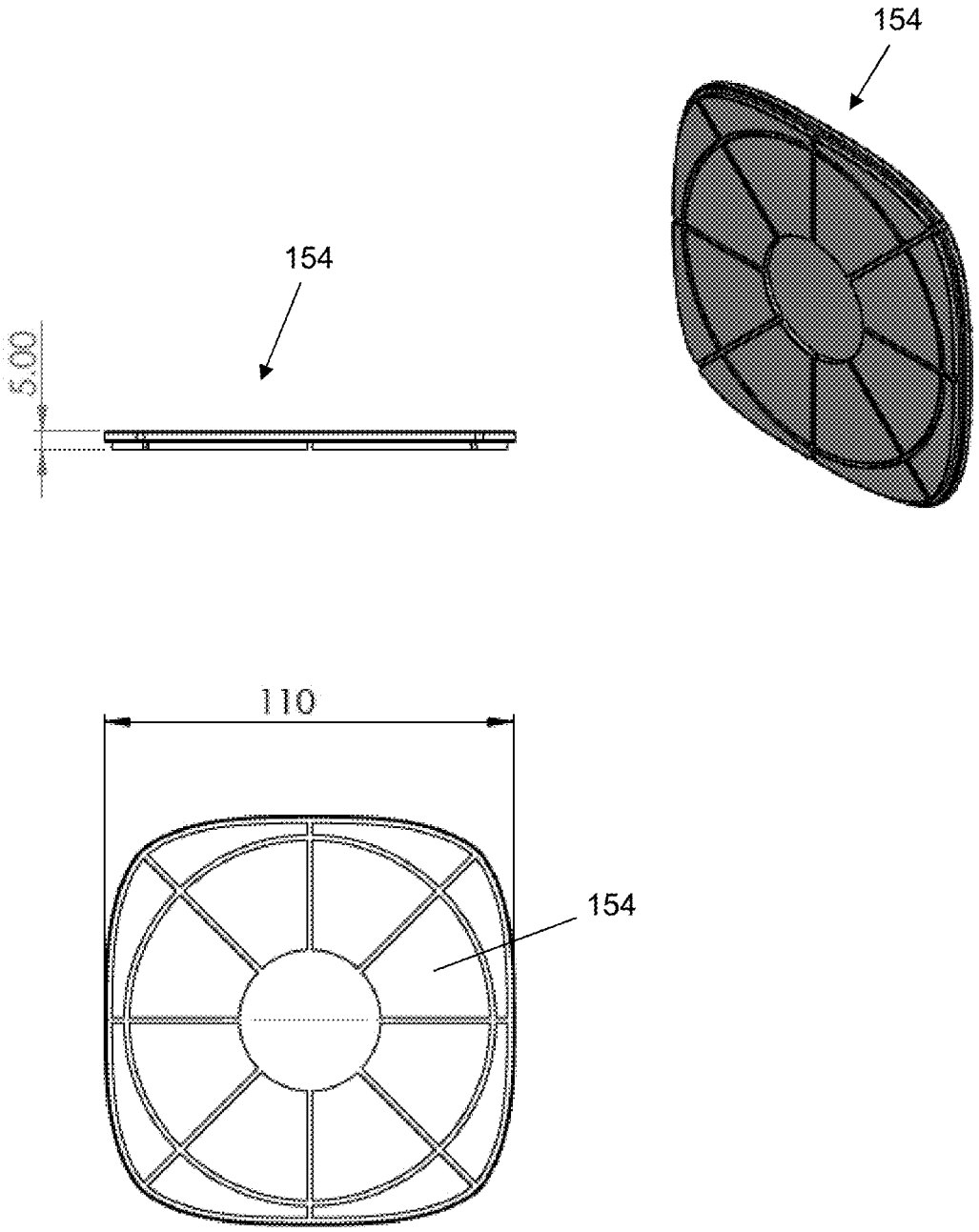
FIG. 18 shows a friction pad for use with the base member shown in FIG. 16.
Figure 19:
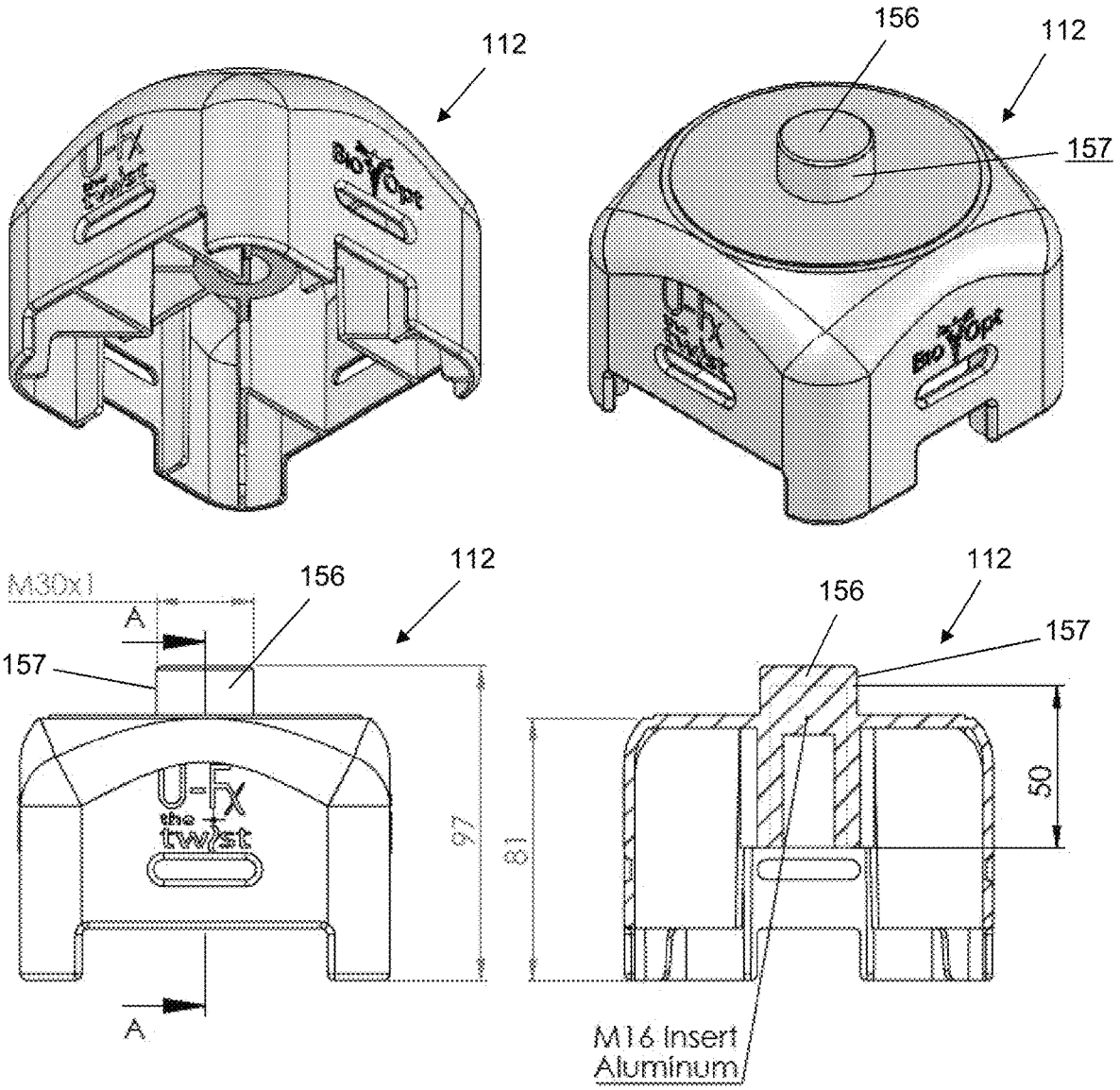
FIG. 19 shows views of the first base member of the modular embodiment of FIG. 14.

FIGS. 14-20 show an alternate embodiment, which is a modular version of the device 100. In this embodiment, a primary base portion 112 and cap portion 114 are formed in separate pieces attachable to one another. FIG. 17 shows an isolation of the cap portion 114 which defines a distal nipple 116 like the earlier embodiments discussed above. As shown, the cap portion 114 includes a central internal bore 152. The bore 152 includes an inner surface 153 that can have threading and/or another contour or texture cooperative for secure attachment. With reference to FIG. 19, the primary base 112 includes a central extension 156 configured to be received by the internal bore 152 to allow a secure attachment of the cap 114 to the primary base 112. The central extension 156 has an outer surface 157 that may also include threads (in the case of a threaded bore) for a screw on attachment to the cap portion 114, or may include another cooperative contour or texture for the same. When the cap and base are attached, the device 100 has the same characteristics and elements, and attaches and operates in the same manner, as the earlier embodiments described above.

Figure 20:
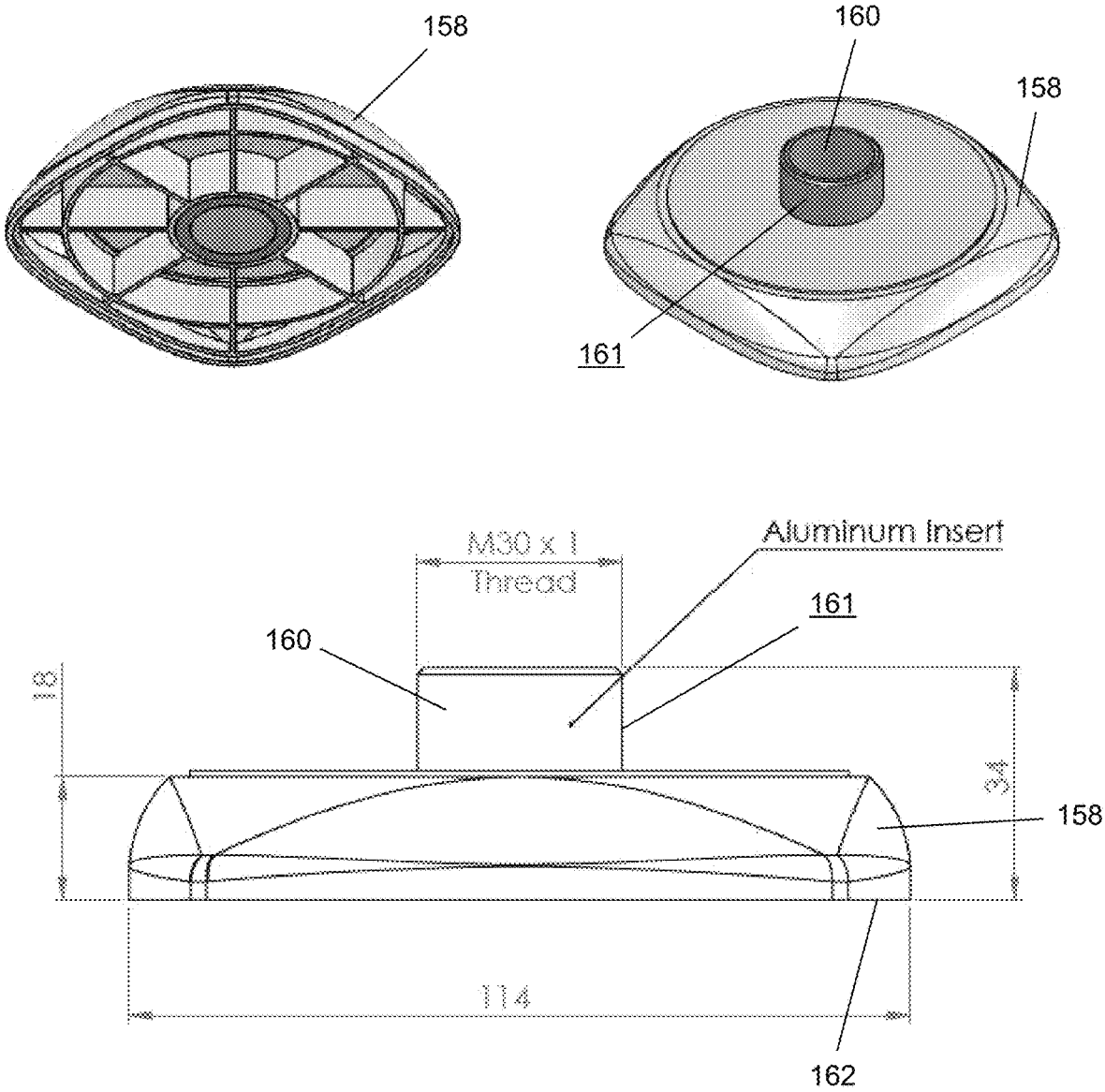
FIG. 20 shows views of the second base member from FIG. 16.
Figure 21:
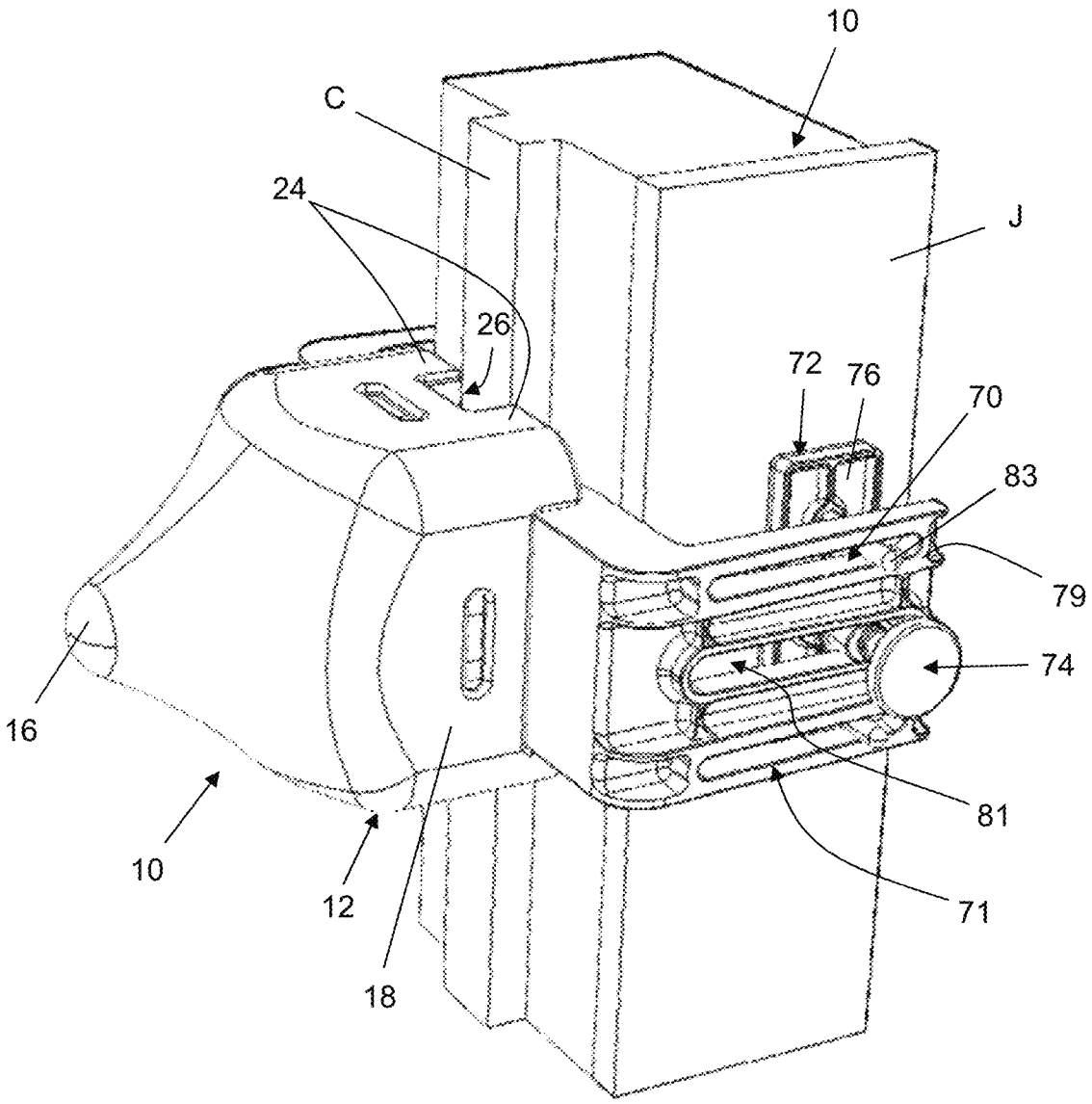
FIG. 21 is a perspective view of a preferred embodiment of the device attached to a stationary structure.

The modular device 100 allows the cap 114 to be detached and attached to different types of base members, such as for example the flat base 158 shown in FIG. 20. As shown, the flat base includes a central extension 160 substantially commensurate in size and shape as that of the primary base 112. Like with the extension 156 of the primary base 112, the extension 160 has an outer surface 161 that may have cooperative threads for secure threaded attachment to the cap portion 114 via the internal bore 152 with threaded inner surface 153. The flat base 158 can be utilized in cooperation with a resilient substantially flat foot 154. The foot 154 is preferably made from a material that provides a tacky or sticky mounting surface, for example, silicon rubber. In operation, a user can employ the flat base 158 with the foot 154 on a surface to exercise and stretch tissue, muscles and joints when attachment via other described means, such as to a door jam via straps, elsewhere via suction, etc., is not feasible. This embodiment is particularly well-suited for travel given the smaller overall profile compared to the device 10 or larger base portion 112.

FIGS. 16-20 include preferred dimensions of key elements and portions of the modular device 100 with flat base 158. All of the characteristics, preferences and options described above with respect to the stand-alone device 10 apply to the modular device 100. For this reason, several elements common between the stand-alone embodiment 10 and modular embodiment 100 are identified with common two-digit reference numerals, except that the modular embodiment includes an additional "1".

FIGS. 21-25 depict a preferred embodiment of a clamping mount 70 for attaching the device 10 (or the device 50 or 100) to a building structure, such as a door jam J. First, with reference to the embodiment shown in FIG. 21, the mount 70 includes an outer frame 71 and inner clamp unit 72 operable by a plunger 74. As shown, the frame 71 is sized to be accommodated within the rear slots 28 of the device 10. In this embodiment, the clamp unit 72 includes a main plate 76 with a resilient pad 87 for improving the secure connection with the door jam J and preventing scuffing or other damage to the door jam surface. The plunger 74 has a shaft 75 with threaded portion that is threaded through a threaded bore 77 in the frame 71. The distal end of the shaft 75 is attached to a clamp unit 72. As shown, the rearwardly extending side arms 79 of the frame 71 define one or more elongate slots 81 for accommodating the plunger shaft 75 and optionally one or more alignment fingers 83.

Figure 22:
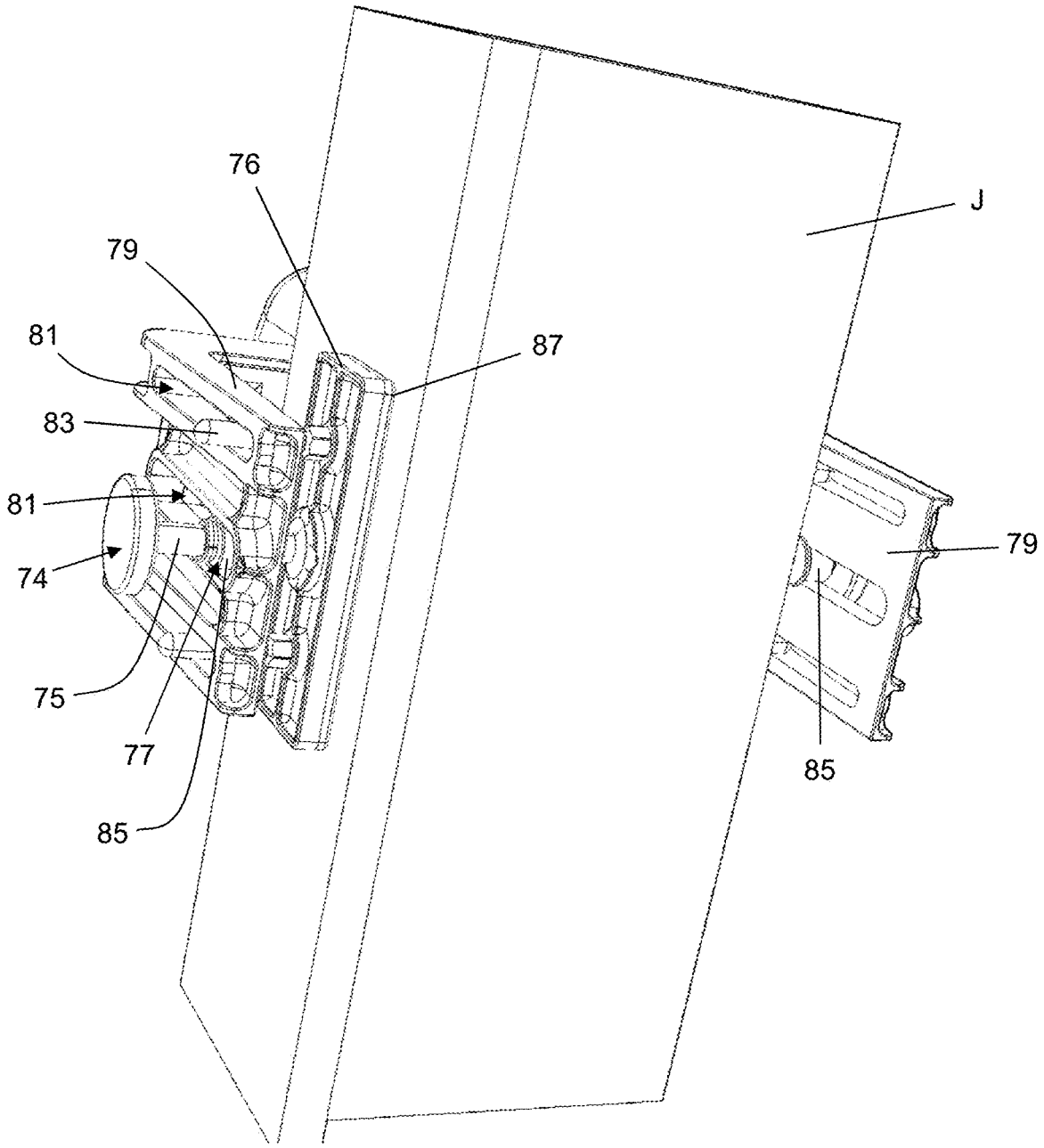
FIG. 22 is a rear perspective view of the attached device of FIG. 21.
Figure 24:
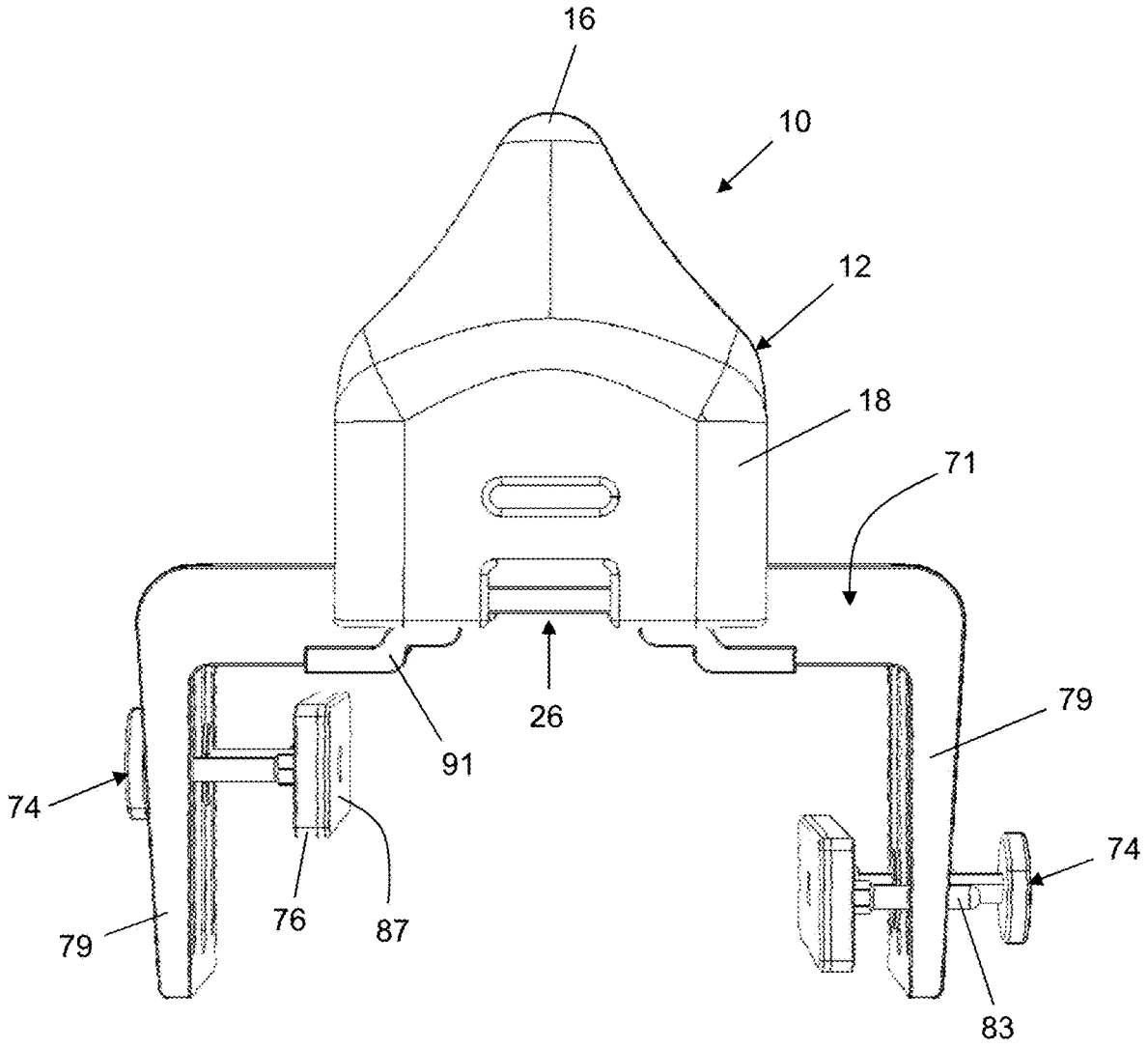
FIG. 24 is a side elevation view of the device of FIG. 21 with the stationary structure removed.
Figure 25:
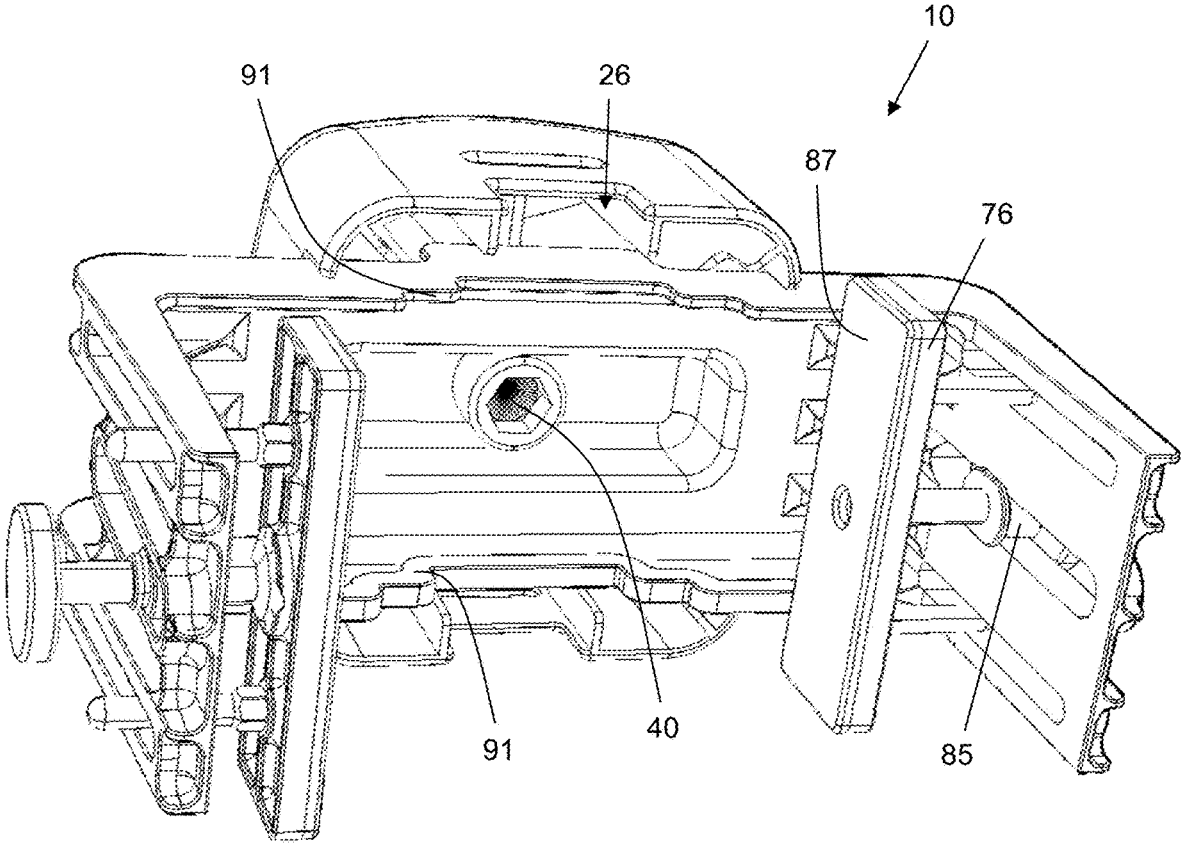
FIG. 25 is a rear perspective view of the device of FIG. 21 with the stationary structure removed.
Figure 26:
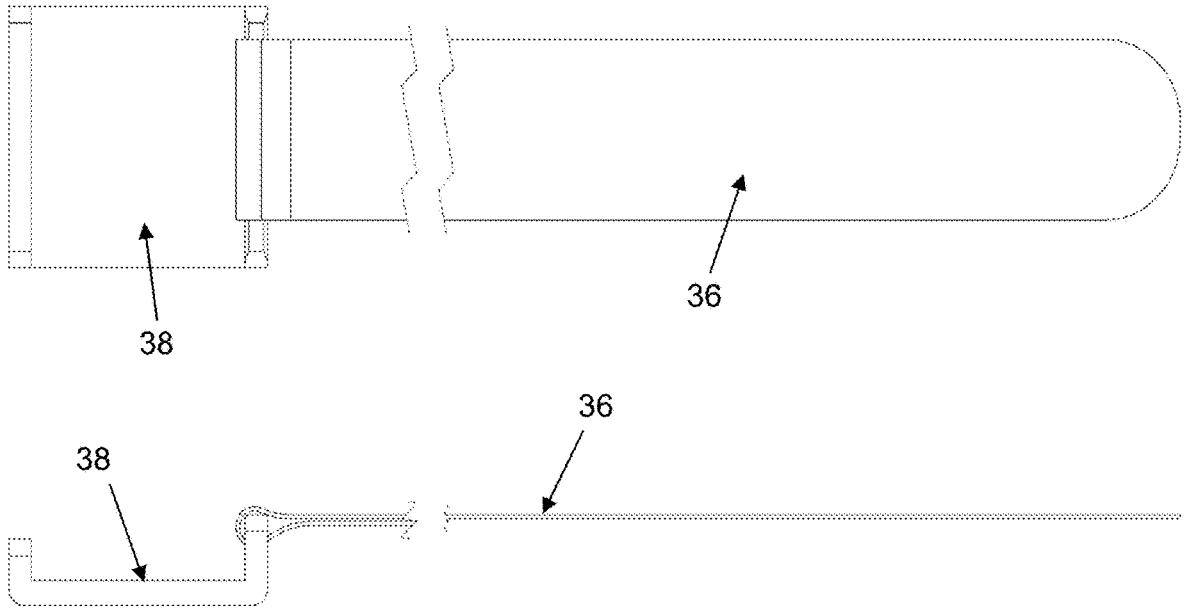
FIG. 26 is an exemplary representation of a strap with hook for use with the disclosed device.
Figure 27:
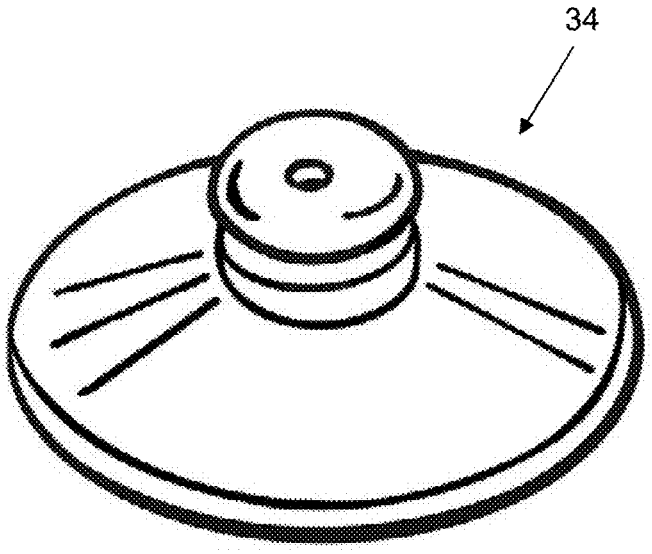
FIG. 27 is a representation of a suction cup for use with the disclosed device.

In this embodiment, as can be seen most clearly in the rear views of FIGS. 22 and 25, the threaded bore 77 in each side can be provided by a ring 85 that is slidable within the center slot 81 of the respective side arm 79. As shown, the ring 85 may include an annular flange on each end to assist attachment to the side arm 79 while maintaining the forward-rearward sliding capability. Notably, the rings 85 need not be perfectly cylindrical and can take a more elongate form with a threaded bore 77 defined therethrough for engagement with the threaded portion of the shaft 75. As seen in FIGS. 24 and 25, additional resilient pads 91 are typically fixed to the rear edges or surfaces of the frame 71 that contact the front of a door jam J or other stationary object. Also shown in the rear view of FIG. 25 is the central bore 40 in the base 12.

Figure 23:
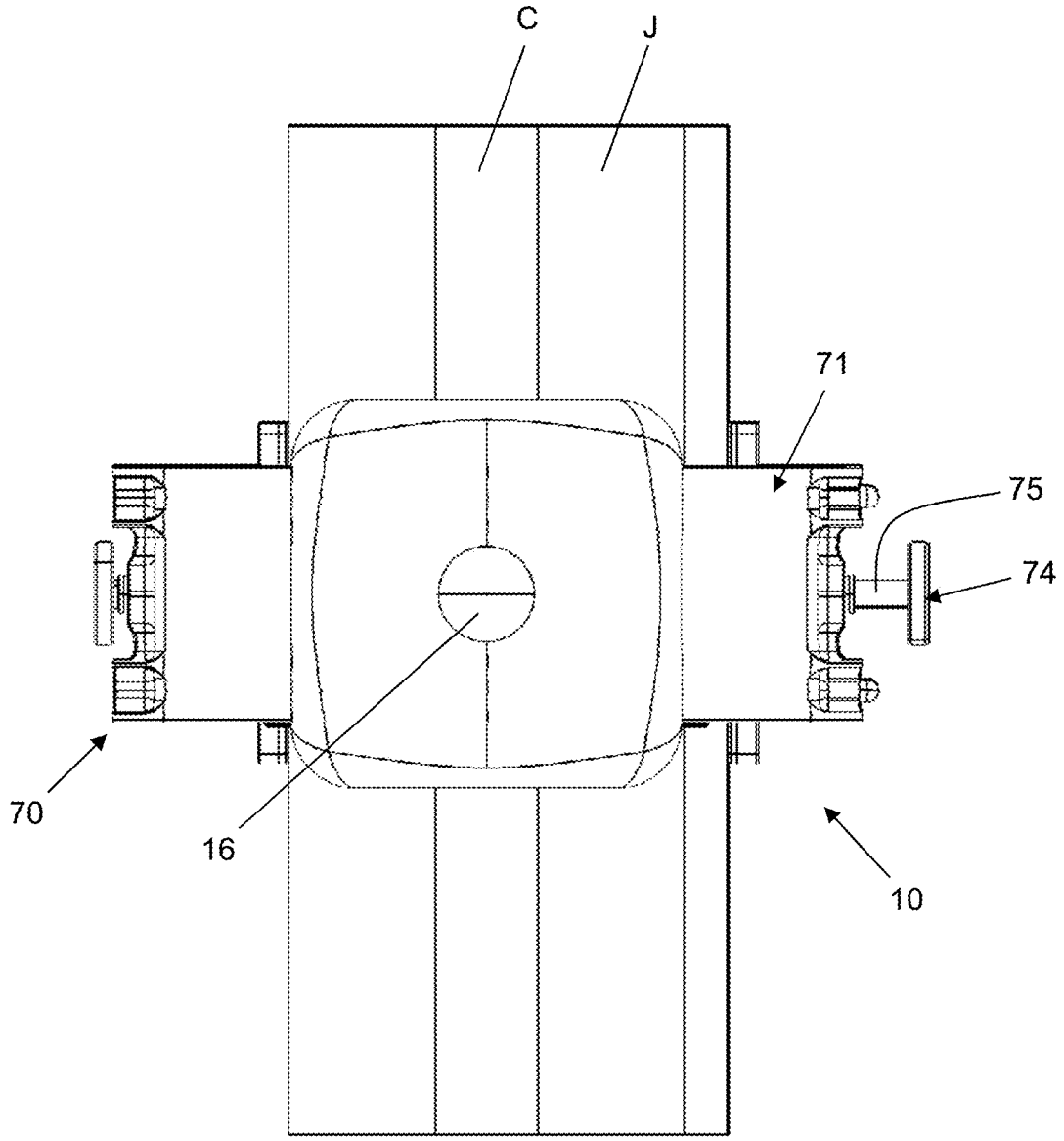
FIG. 23 is a front elevation view of the attached device of FIG. 21.

Once the mount is in place on the door jam J, a user can adjust forward-rearward positioning of the plates 76 by sliding within the slots 81 and then tighten the clamp 72 via threading the plunger 74 inwardly to rigidly secure the device 10 to the door jam J. The rear slot 26 in the base 12 of the device is sized, shaped and positioned to accommodate a central portion C of the door jam J and utilize additional contact surfaces to mechanically prevent movement of the device 10 during use. FIG. 23 depicts the clamped device 10, showing the typical rigid attachment and alignment of the device to the door jam J.

Additional embodiments of the clamping mount exist with slightly different or additional features from that shown in FIGS. 21-25. Embodiments exist with variations on the clamp unit 72, for example, including a front flange on the plates 76 that extends inward to abut the front surface of the outer portions of the door jam J.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. An exercise device, comprising:

a first base member with rear portion configured for rigid engagement with a stationary object, the rear portion defining a rear end;

a transition portion extending from the first base member in a distal direction away from the rear portion; and a nipple with a rounded contour formed as the distal end of the transition portion, wherein the nipple is rigidly fixed relative to the first base member, and the nipple is rigidly fixed relative to the stationary object when the rear portion of the first base member is engaged with the stationary object, and the rear portion includes a first pair of opposing slots having a first slot width W3 and a second pair of opposing slots having a second slot width W4 that is different from W3, each of the slots of the first and second pair being opened toward the rear end.

2. The device of claim 1, wherein the rear portion of the first base member comprises a plurality of feet spaced from one another with both slots of the first pair and both slots of the second pair defined between a pair of the spaced apart feet.

3. The device of claim 1, further comprising a clamp for attachment to the stationary object.

4. The device of claim 3, wherein the clamp is configured to attach to the stationary object with an elongate portion of the stationary object extending through the two opposing slots having a first slot width W3 or the two opposing slots having a second slot width W4.

5. The device of claim 1, wherein the rigid nipple is disengagable from the base member.

6. The device of claim 5, wherein the base member is configured to be attachable to a front member different from the rigid nipple.

7. The device of claim 1, further comprising a second base member having a different rear configuration from the first base member, wherein the rigid nipple is attachable and detachable to the second base member.

8. The device of claim 1, comprising a threaded bore in the rear portion of the body.

9. The device of claim 1, wherein the first pair of slots are laterally aligned with one another along opposing edges of the rear portion and the second pair of slots are longitudinally aligned with one another along different opposing edges of the rear portion.

10. The device of claim 1, comprising one or more straps configured to extend rearwardly from the rear end to attach the device to the stationary object.

11. The device of claim 1, wherein the first pair of opposing slots are aligned to provide a first channel through opposite sides of the rear portion and the second pair of opposing slots are aligned to provide a second channel through opposite sides of the rear portion and the first channel is substantially perpendicular to the second channel.

12. An exercise system, comprising:

a stationary object having a first width W1;

an exercise device comprising a rear base portion that transitions to a front rigid nipple, the rear base portion defining a rear end and having a second width W2, the rear base portion including a first pair of opposing slots having a first slot width W3 and a second pair of opposing slots having a second slot width W4 that is different from W3, each of the slots being opened toward the rear end, wherein the exercise device is rigidly attached to the stationary object at the rear base portion with an elongate portion of the stationary object extending through the first pair of opposing slots or the second pair of opposing slots, thereby rigidly fixing the nipple relative to the stationary object.

13. The exercise system of claim 12, wherein the exercise device is rigidly attached to the stationary object at the rear base portion such that clearance is provided rear of the base portion on both sides of the second width W2.

14. The exercise system of claim 12, wherein the stationary object is selected from the group consisting of a building structure and a frame.

15. The exercise system of claim 12, wherein the stationary object is a door jam with a central upright section extending through the two opposing slots having a first slot width W3 or the two opposing slots having a second slot width W4.

16. The exercise system of claim 12, further comprising a clamp member configured to attach the exercise device to the stationary object via clamping engagement.

17. The exercise system of claim 12, wherein the rear base portion is detachable from a cap member that includes the nipple.

18. The exercise system of claim 17, wherein the rear base portion comprises an extension and the cap member comprises an internal opening configured to receive the extension to assist attachment of the cap member to the base portion.

19. The exercise system of claim 13, comprising one or more straps configured to extend rearwardly from the rear end to attach the device to the stationary object, with the elongate portion extending through the respective pair of slots.

* * * * *